US010015847B1

(12) United States Patent
Lavenziano

(10) Patent No.: US 10,015,847 B1
(45) Date of Patent: Jul. 3, 2018

(54) MULTI-CAVITY MICROWAVE COOKING APPLIANCE

(71) Applicant: Andrew C. Lavenziano, Hackensack, NJ (US)

(72) Inventor: Andrew C. Lavenziano, Hackensack, NJ (US)

( * ) Notice: Subject to any disclaimer, the term of this patent is extended or adjusted under 35 U.S.C. 154(b) by 541 days.

(21) Appl. No.: 14/159,980

(22) Filed: Jan. 21, 2014

(51) Int. Cl.
*H05B 6/80* (2006.01)

(52) U.S. Cl.
CPC ..... *H05B 6/804* (2013.01); *H05B 6/80* (2013.01)

(58) Field of Classification Search
CPC ... H05B 6/6408; H05B 2206/044; H05B 6/80
USPC ..... 219/689, 389
See application file for complete search history.

(56) References Cited

U.S. PATENT DOCUMENTS 4,177,369 A * 12/1979 Fritts ..... G05B 19/104 219/716
4,598,689 A * 7/1986 Eke ..... H05B 6/642 126/21 A
4,691,088 A * 9/1987 Eke ..... F24C 15/325 219/681
D334,320 S * 3/1993 Van Tol ..... D7/351
5,223,685 A * 6/1993 DeRienzo, Jr. ..... H05B 6/6408 219/732
5,272,302 A * 12/1993 Dudley ..... H05B 6/6402 219/729
5,468,940 A * 11/1995 Kang ..... H05B 6/6408 219/718
5,498,856 A * 3/1996 Carlsson ..... H05B 6/6402 219/689
5,726,428 A * 3/1998 Christensen ..... H05B 6/6408 126/338
5,874,714 A * 2/1999 Sik ..... H05B 6/6426 126/21 A
5,893,997 A * 4/1999 Gustafsson ..... F24C 7/087 219/714
5,958,277 A * 9/1999 Lee ..... H05B 6/6408 219/702
6,242,724 B1 * 6/2001 Lee ..... H05B 6/6426 219/752
D468,962 S 1/2003 Jones et al.
6,815,644 B1 * 11/2004 Muegge ..... F24C 1/04 126/332
7,087,872 B1 * 8/2006 Dobie ..... F24C 15/166 219/401
7,708,008 B2 5/2010 Elkasevic et al.
D699,504 S * 2/2014 Eades ..... D7/351
(Continued)

*Primary Examiner* — Dana Ross
*Assistant Examiner* — Lawrence Samuels
(74) *Attorney, Agent, or Firm* — Aaron R. Cramer; Cramer Patent & Design, PLLC.

(57) ABSTRACT

A multi-cavity microwave cooking appliance provides at least two (2) microwave cooking ovens a vertically elongated third beverage heating unit in at least one (1) embodiment. In general, each of the ovens and the heating unit are operated and controlled independently from each other. However, the ovens and heating unit may be controlled together if a particular switch is pressed. Each oven and the heating unit have separate access doors, magnetrons, and control switches. A control unit can be used to enter cooking information to the ovens and heating unit. The multi-cavity microwave cooking appliance further supports a tray and turntables.

19 Claims, 7 Drawing Sheets

(56) References Cited

U.S. PATENT DOCUMENTS

| | | | | |
|---|---|---|---|---|
| 2005/0236388 | A1* | 10/2005 | Goranson | A21B 1/245 219/400 |
| 2007/0045303 | A1* | 3/2007 | Smith | H05B 6/6408 219/732 |
| 2007/0175891 | A1* | 8/2007 | Maeda | H05B 6/6417 219/720 |
| 2008/0156202 | A1* | 7/2008 | Park | F24C 15/02 99/467 |
| 2009/0236332 | A1* | 9/2009 | Adams | H05B 6/6411 219/702 |
| 2010/0193499 | A1* | 8/2010 | Blazevich | F24C 15/02 219/394 |
| 2010/0282742 | A1* | 11/2010 | Uchiyama | H05B 6/6402 219/702 |
| 2011/0006056 | A1* | 1/2011 | Choi | H05B 6/642 219/757 |
| 2013/0153570 | A1* | 6/2013 | Carlsson | H05B 6/80 219/702 |
| 2013/0168384 | A1* | 7/2013 | Cadima | H01F 38/14 219/647 |

* cited by examiner

MULTI-CAVITY MICROWAVE COOKING APPLIANCE

RELATED APPLICATIONS

There are no related applications.

FIELD OF THE INVENTION

The presently disclosed subject matter is directed toward cooking appliances. More particularly, the present invention relates to multi-cavity microwave ovens.

BACKGROUND OF THE INVENTION

Modern society has developed a wide range of useful appliances and devices. One (1) area that has seen rapid growth of such appliances and devices is food preparation. Cutters, choppers, blenders, juicers, bread machines, can openers, waffle makers, salad makers, electric knives, salad forks and countless other devices and appliances have been developed to make cooking faster, easier, and more enjoyable.

Among the modern food preparation conveniences that have been developed in recent years is the very popular and widely used microwave oven. Today, few homes and even fewer restaurants and commercial kitchens do not have at least one (1) microwave oven. Microwave ovens are used to thaw foods, reheat leftovers, heat beverages, cook prepared meals, make popcorn and for numerous other tasks. Because of their speed and convenience microwave ovens are particularly helpful in coping with today's fast-paced lifestyles.

The microwave oven has been rapidly evolved into a variety of low cost, efficient, relatively compact appliances. Many households and lunchrooms have found that one (1) microwave is insufficient. Some foods require cooking, others require warming, and yet others may require defrosting. Since a microwave can only operate at one setting at a time some users are forced to wait until one (1) food is done before the other is started. This means that the food that was initially warmed or cooked is growing cold. Such problems are compounded in company lunchrooms where many employees may all want to use the microwave oven at the same time. While more microwave ovens can be added, space is often at a premium and the resulting cost and aesthetics of multiple microwave ovens can be unwanted.

Accordingly, there exists a need for microwave ovens which can prepare various foodstuffs and beverages simultaneously. Preferably such microwave ovens would take up less space than multiple microwave ovens, would cost less than multiple microwave ovens, and would have improved aesthetics over multiple microwave ovens. Even more preferably such microwave ovens would enable a single controller to control two (2) or more microwave cavities. In practice having a vertically-orientated beverage microwave cavity would be useful. Ideally such a microwave oven would be easy to use, incorporate easily-operated switches such as push-button, momentary contact, and touch screens. In practice user feedback displays in the form of LED's (light-emitting diodes), LCD (liquid crystal displays), plasma displays, CRT (cathode ray tube) displays, fluorescent displays, and analog displays would be useful.

SUMMARY OF THE INVENTION

The principles of the present invention provide for a multi-cavity microwave cooking appliance capable of preparing multiple dishes simultaneously. A multi-cavity microwave cooking appliance in accord with the present invention includes an enclosure having a first heating cavity, at least a second heating cavity, and possibly a third heating cavity, such as a vertically elongated beverage heating cavity. A first cavity door selectively opens and closes the first heating cavity, a second cavity door selectively opens and closes the second heating cavity, and a third cavity door, such as a beverage cavity door selectively opens and closes the third (beverage) heating cavity. A first cavity access lever is provided for opening the first cavity access door; a second cavity access lever is provided for opening the second cavity access door, and a beverage cavity access lever is provided for opening the beverage cavity access door.

The multi-cavity microwave cooking appliance includes a control panel for setting separate and independent cooking levels within the first heating cavity, the second heating cavity, and the third (beverage) heating cavity. A first cavity magnetron selectively supplies microwave energy to the first cavity; a second cavity magnetron selectively supplies microwave energy to the second cavity, and a third (beverage) cavity magnetron may selectively supply microwave energy to the third (beverage) cavity. Also included is a power supply for selectively applying magnetron operating voltages to the first cavity magnetron, to the second cavity magnetron, and to the third (beverage) cavity magnetron. The power supply also supplies an electronic operating voltage to a main controller. The main controller accepts user commands from the control panel and controls the power supply to selectively apply magnetron operating voltages to the first cavity magnetron, to the second cavity magnetron, and to the beverage cavity magnetron. The control panel may include easily operated switches such as push-buttons, momentary contact, and touch screens.

Beneficially, the multi-cavity microwave cooking appliance includes a first alphanumeric display for providing a user with information regarding the first cavity; a second alphanumeric display for providing a user with information regarding the second cavity; and a third (beverage) alphanumeric display for providing a user with information regarding the beverage cavity. The first alphanumeric display, the second alphanumeric display, and the third (beverage) alphanumeric display are operatively connected to the main controller. In practice the alphanumeric displays may include LED's (light-emitting diodes), LCDs (liquid-crystal displays), plasma displays, CRT (cathode ray tube) displays, fluorescent displays, and/or analog displays.

The multi-cavity microwave cooking appliance beneficially includes at least a first alphanumeric display which is located on the first cavity door. The first alphanumeric display preferably provides information regarding the first cavity such as the time of day, cooking levels, cooking times, times remaining, and temperature.

In practice the first heating cavity can be separated into two (2) heating sections by a first removable rack, the second heating cavity can be separated into two (2) heating sections by a second removable rack or tray, and the beverage heating cavity can be separated divided into two (2) heating sections by a removable beverage tray, shelf, or rack.

Additionally, the control panel preferably includes a first selector switch, a second selector switch, a third (beverage) selector switch, and an all-selector switch. The main controller controls the first cavity magnetron if the first selector switch was last pressed, controls the second cavity magnetron if the second selector switch was last pressed, controls the third (beverage) cavity magnetron if the third (beverage)

selector switch was last pressed, and the first cavity magnetron, the second cavity magnetron, and the third (beverage) cavity magnetron if the all-selector switch was last pressed.

In practice, the control panel applies a mode selector command to the main controller. The mode selector command can include a command from a list consisting of cook, time, date, keep warm and defrost. Alternatively or in addition, the control panel may apply a sensor cook command to the main controller. The sensor cook command can include a command from a list consisting of popcorn, rice, frozen vegetables, ground meat, baked potato, frozen entrees, fresh vegetables, fish, and seafood. Alternatively or in addition, the control panel may apply a defrost mode command to the main controller. The defrost mode command may be a command selected from a list consisting of ground meat, steaks, chops, chicken.

Alternatively or in addition, the control panel may apply a numeric command to the main controller. The numeric command may include a command from a list consisting of cooking time, current time, power level and weight. Alternatively or in addition, the control panel might apply an auxiliary operation parameter to the main controller. The auxiliary operation parameter may include a command from a list consisting of timer, clock, power level, stop, clear and start.

An alternative cooking appliance that is in accord with the present invention includes an enclosure forming a first heating cavity and a second heating cavity. There is a first door for selectively opening and closing the first heating cavity and a second door for selectively opening and closing the second heating cavity. A first cavity access lever for opens the first door while a second cavity access lever opens the second door. The cooking appliance further includes a control panel for setting separate and independent cooking levels within the first heating cavity and the second heating cavity. A first magnetron supplies microwave energy to the first cavity and a second magnetron supplies microwave energy to the second cavity. A power supply applies operating voltages to the first magnetron and to the second magnetron as well as an electronic operating voltage. A main controller accepts the user commands and then selectively controls the operation of the first magnetron and the second magnetron such that independent cooking levels are set within the first heating cavity and the second heating cavity.

The alternative cooking appliance may include feet on the bottom of the enclosure and those feet may be on adjustable legs. A removable tray supported by shelf guide is beneficially included. That removable tray may include a turntable. If so, the removable tray may include a plug for receiving electrical power to operate the turntable; the enclosure may have a power tap for mating with the plug to transfer electrical power, and the main controller may selectively send electrical power to the power tap. Alternatively or in addition, the cooking appliance may include a fan for cooling the first magnetron. Preferably that fan is prevented from operating when the first door is open.

In practice the enclosure may further include a third heating cavity. If so, there may be a third door for selectively opening and closing the third heating cavity, a third cavity access lever for opening the third door, and a third magnetron for supplying microwave energy to the third heating cavity. The power supply would then apply operating voltages to the third magnetron; the main controller would further accept user commands from the control panel and selectively independently controlling the operation of the third magnetron. Beneficially the third cavity would be vertically oriented.

In practice the controller enables separate and independent cooking levels within the first heating cavity, the second heating cavity, and the third (beverage) heating cavity.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
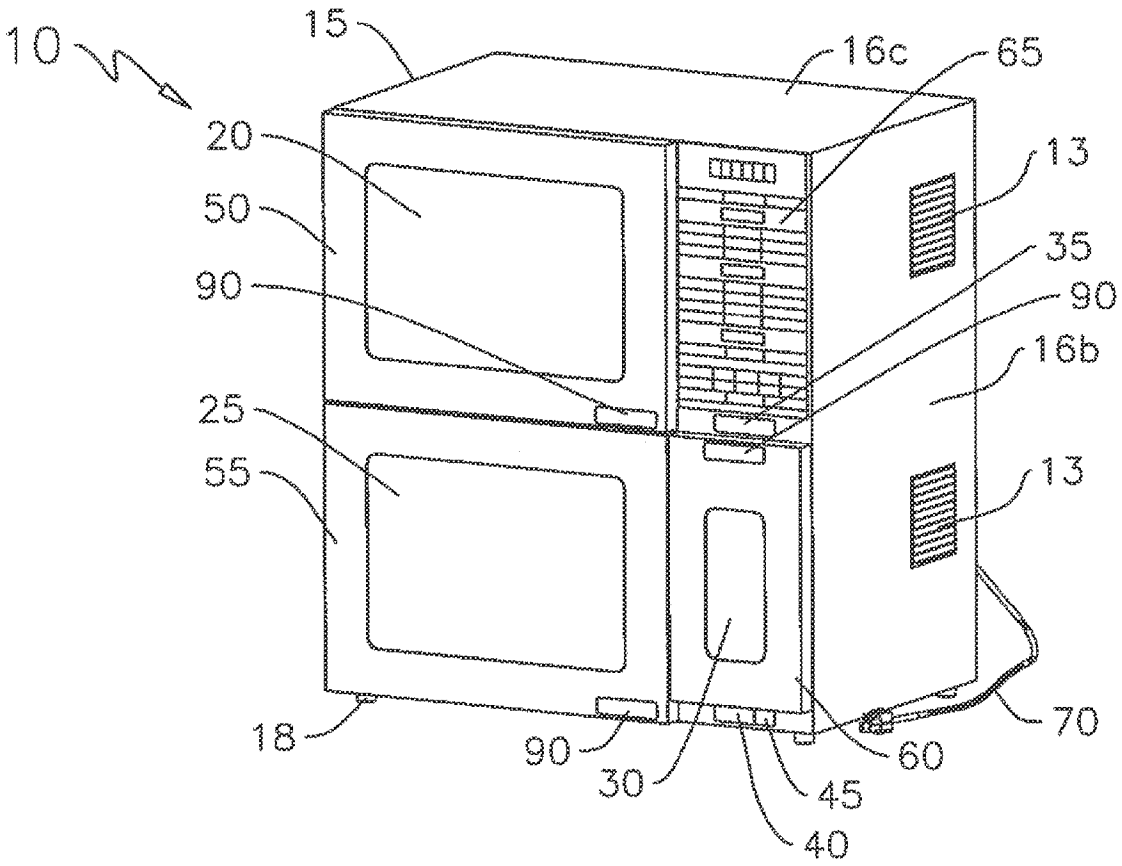
FIG. 1 presents an isometric view of a closed multi-cavity microwave cooking appliance 10 that is in accord with the preferred embodiment of the present invention.

10 multi-cavity microwave cooking appliance
12 opening
13 louvered vent
15 enclosure
**16*a*** enclosure back
**16*b*** enclosure right side
**16*c*** enclosure top
**16*d*** enclosure bottom
**16*e*** enclosure left side
18 foot
19 leveling leg
20 top heating cavity
21 top cavity light switch
22 top cavity light
25 bottom heating cavity
26 bottom cavity light switch
27 bottom cavity light
30 beverage heating cavity
31 beverage cavity light switch
32 beverage cavity light
35 top cavity access lever
36 top cavity door interlock
40 bottom cavity access lever
42 bottom cavity door interlock
45 beverage cavity access lever
46 beverage cavity door interlock
50 top cavity door
55 bottom cavity door

60 beverage cavity door
65 control panel
70 power cord
75 removable rack
80 upper heating section
85 lower heating section
90 alphanumeric display
95 top selector switch
100 bottom selector switch
105 beverage selector switch
110 all-selector switch
115 mode selector switches
120 sensor cook section
125 sensor cook mode selection switches
130 instant action section
135 instant action mode selection switches
140 defrost section
145 defrost mode selection switches
150 numeric keypad
155 auxiliary operation parameter switches
160 power supply
165 top cavity magnetron
170 bottom cavity magnetron
175 beverage cavity magnetron
180 main controller
185 fan
190 cavity turntable
200 electric motor
205 drive shaft
210 drive hub
215 teeth
220 turntable plate
225 projection
230 bearing ring
235 shelf guide
240 tray
265 power tap
270 plug
280 upper heating section
285 lower heating section

DETAILED DESCRIPTION OF THE PREFERRED EMBODIMENT

The best mode for carrying out the invention is presented in terms of its preferred embodiment, herein depicted within FIGS. 1 through 7. However, the invention is not limited to the specifically described embodiment. A person skilled in the art will appreciate that many other embodiments of the invention are possible without deviating from the basic concept of the invention. Any such work around will also fall under scope of this invention. While only one particular configuration is shown and described that is for purposes of clarity and disclosure and not by way of limitation of scope.

The terms "a" and "an" herein do not denote a limitation of quantity, but rather denote the presence of at least one of the referenced items. In addition, direction signals such as up, down, left, right interior, exterior are taken relative to FIG. 1.

Figure 5:
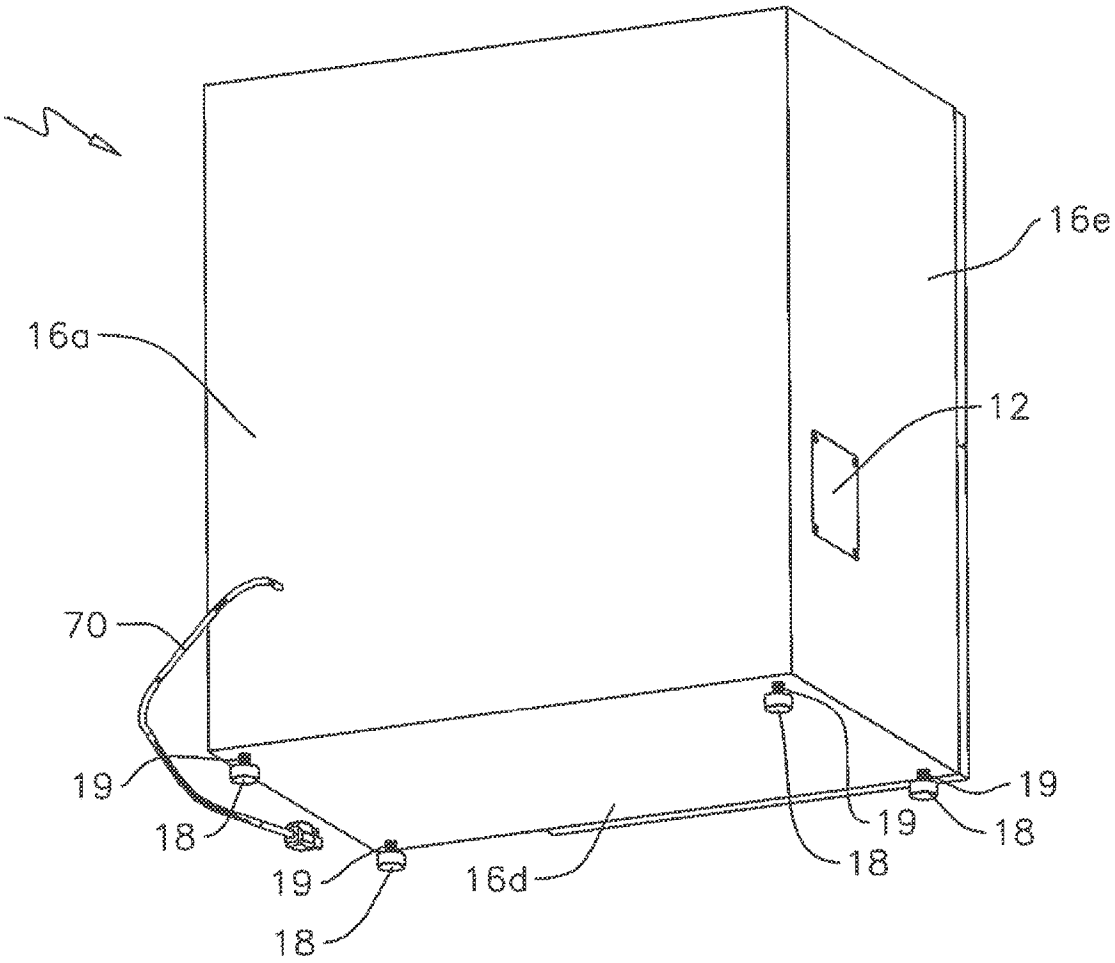
FIG. 5 shows an isometric view of the rear and the bottom of the multi-cavity microwave cooking appliance 10 shown in FIGS. 1 and 2.

FIG. 1 presents an isometric view of a closed multi-cavity microwave cooking appliance 10 that is in accord with the present invention. FIG. 5 presents an isometric view of the rear and the bottom of the multi-cavity microwave cooking appliance 10. Referring to those figures as required, the multi-cavity microwave cooking appliance 10 includes an enclosure 15 that is envisioned as being made of sheet metal. The enclosure 15 is comprised of an enclosure back 16*a*, a right side 16*b*, a left side 16*e*, an enclosure top 16*c*, and an enclosure bottom 16*d*. The enclosure 15 may be configured in one (1) piece, or as a plurality of interconnected pieces to envelope, protect, and support the internal components of the multi-cavity microwave cooking appliance 10. As such, the enclosure 15 may include any structural reinforcement provisions, fastener apertures, or other features as may be deemed necessary to accomplish these tasks. For example, the enclosure 15 preferably includes microwave shielding to prevent radiation leakage and openings 12 for louvered vents 13.

Still referring to FIGS. 1 and 5, the enclosure bottom 16*d* includes a plurality of cylindrical or conical rubber or urethane feet 18 that are beneficially located on adjustable leveling legs 19. The feet 18 and the leveling legs 19 are useful for elevating and leveling the multi-cavity microwave cooking appliance 10 when used on a table or shelf. The leveling legs 19 may be comprised of a cylindrical polymer compound, or nitrile, formed around preferably a threaded metal rod, and engaged in a threaded metal insert permanently affixed to the enclosure bottom 16*d*. The feet 18 are preferably a non-skidding rubber, urethane, or other plastic. Other feet 18, such as cushioned glides, or welded plates or brackets, or other leveling legs 19 may be used. The feet 18 and leveling legs 19 maybe omitted or removed for under-cabinet mounting.

The louvered vents 13 enable exchanging ambient air for heated exhaust air to provide cooling. A louvered vent 13 will have at least one (1) opening but multiple louvers are preferred. While not shown, one (1) or more of the louvered vents 13 may include a screen or filter, possibly washable to provide cleaner intake air while excluding insects and vermin.

Figure 4:
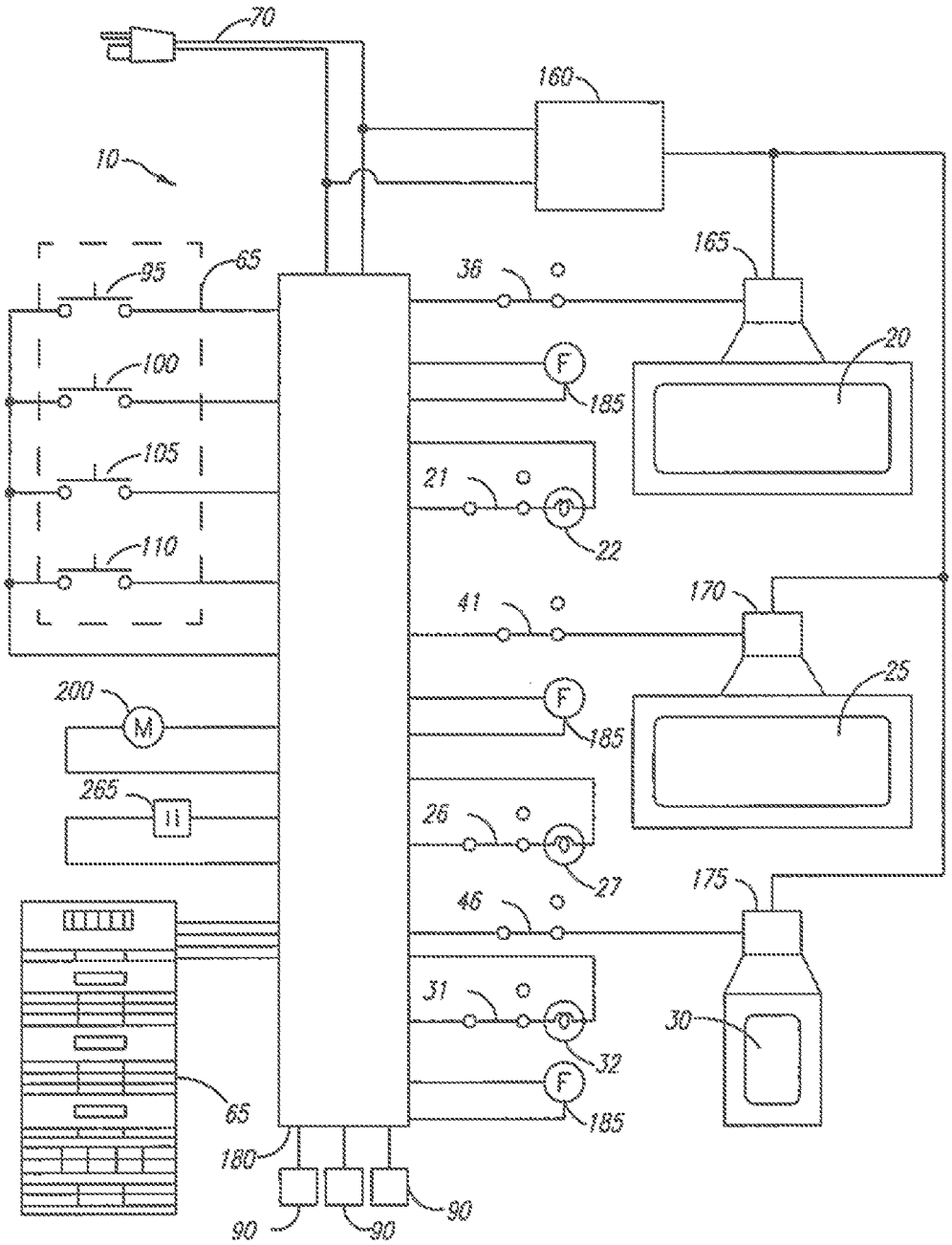
FIG. 4 is a schematic block diagram of the electrical components of the multi-cavity microwave cooking appliance 10 shown in FIGS. 1 and 2.

Referring now to FIG. 4, because of the power levels required to operate the multiple microwave cavities used in the multi-cavity microwave cooking appliance 10, each louvered vent 13 is preferably provided with its own fan 185 to cool a magnetron. Fans 185 are typically mounted to cool a top cavity magnetron 165, a bottom cavity magnetron 170, and a beverage cavity magnetron 175. If required, another fan 185 may be provided to cool a power supply 160. The fans 185 may be single speed or multi-speed fan 185. Ductwork can be used to provide sufficient ventilation to meet the needs of the multi-cavity microwave cooking appliance 10.

Figure 2:
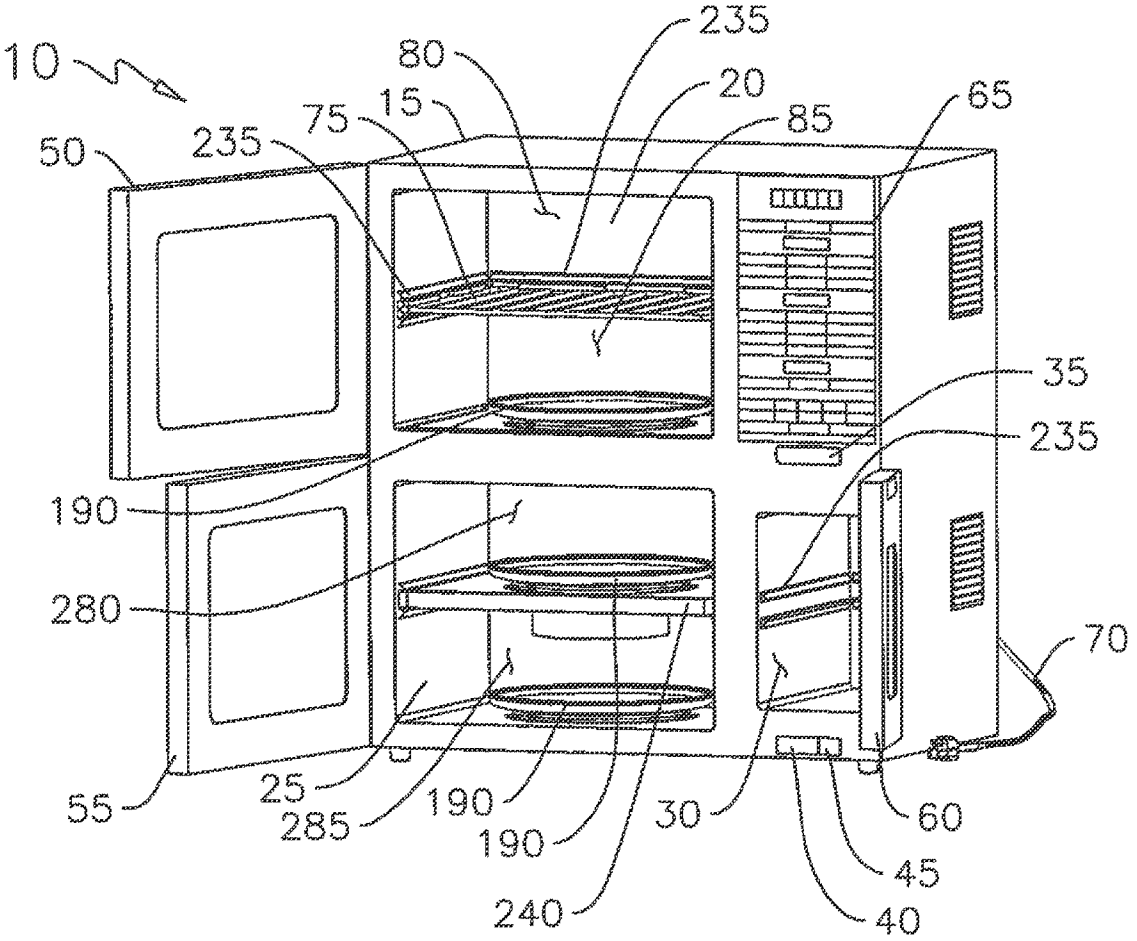
FIG. 2 shows an isometric view of the multi-cavity microwave cooking appliance 10 of FIG. 1 when opened.

Referring now to FIGS. 1 and 2, the enclosure 15 has a top heating cavity 20, a bottom heating cavity 25, and a beverage heating cavity 30. Although the third heating cavity is shown and described as a beverage heating cavity 30 the principles of the present invention are broader than that. Thus, the third heating cavity does not necessarily have to be configured for or, even if so configured, used for heating beverages.

Referring now primarily to FIGS. 1 and 4, access into the top heating cavity 20, bottom heating cavity 25, and beverage heating cavity 30 are respectively provided by a top cavity access lever 35, a bottom cavity access lever 40, and a beverage cavity access lever 45. Pressing the top cavity access lever 35 causes a top cavity door 50 to open. The top cavity access lever 35 is provided with an electro-mechanical top cavity door interlock 36 which interrupts electrical power to the top cavity magnetron 165 when the top cavity access lever 35 is depressed or when the top cavity door 50 is open and unlatched. Pressing the top cavity access lever 35 also closes a top cavity light switch 21. Closing the top cavity light switch 21 causes a top cavity light 22 to illuminate the top heating cavity 20. The top cavity light 22

(as well as a bottom cavity light 27 and a beverage cavity light 32 discussed below) may be any device capable of converting electrical energy into light energy, such as an incandescent bulb, or a light-emitting diode (LED).

Pressing the bottom cavity access lever 40 causes a bottom cavity door 55 to open. The bottom cavity access lever 40 is provided with an electro-mechanical bottom cavity door interlock 42. The bottom cavity door interlock 42 interrupts electrical power to the bottom cavity magnetron 170 when the bottom cavity access lever 40 is depressed or the bottom cavity door 55 is open. The bottom cavity door interlock 42 prevents power from being applied to the bottom cavity magnetron 170 until the bottom cavity door 55 is closed and latched. Opening the bottom cavity door 55 closes a bottom cavity light switch 26. That causes electrical power to flow to a bottom cavity light 27 that illuminates the bottom cavity 25.

Pressing the beverage cavity access lever 45 causes a beverage cavity door 60 to open. The beverage cavity access lever 45 operates a beverage cavity door interlock 46 which interrupts electrical power circuitry to the beverage cavity magnetron 175 when the beverage cavity door 60 is open and unlatched. The beverage cavity door interlock 46 prevents electrical power from being applied to the beverage cavity magnetron 175 until the beverage cavity door 60 is closed and latched. Pressing the beverage cavity access lever 45 closes a beverage cavity light switch 31 which causes a beverage cavity light 32 to illuminate the beverage heating cavity 30.

Electrical power for the multi-cavity microwave cooking appliance 10 is provided to the power supply 160 through a power cord 70.

Still referring primarily to FIGS. 1 and 4, the control of the various operating parameters of the multi-cavity microwave cooking appliance 10 is provided by a control panel 65. Information regarding the status and operation of the multi-cavity microwave cooking appliance 10 is output to a user on a set of alphanumeric displays 90. The operations of the control panel 65 and the alphanumeric displays 90 are described in more detail subsequently. The alphanumeric displays 90 may include one (1) or more LED's, LCD's, plasma displays, CRT displays, fluorescent displays, and/or analog displays. Selections amongst those displays will depend upon cost, desired features, aesthetics, size, power consumption, and numerous other factors.

It is envisioned that the multi-cavity microwave cooking appliance 10 will be made available in forms suitable for under-cabinet mounting and for countertop placement. It is further envisioned that the multi-cavity microwave cooking appliance 10 will be made available in forms suitable for residential, commercial, and institutional use. In particular, it is envisioned that the multi-cavity microwave cooking appliance 10 would be provided in a form for use in break rooms, lunchrooms, cafeterias, and other locations where multiple people can use the multi-cavity microwave cooking appliance 10 at once.

Figure 6:
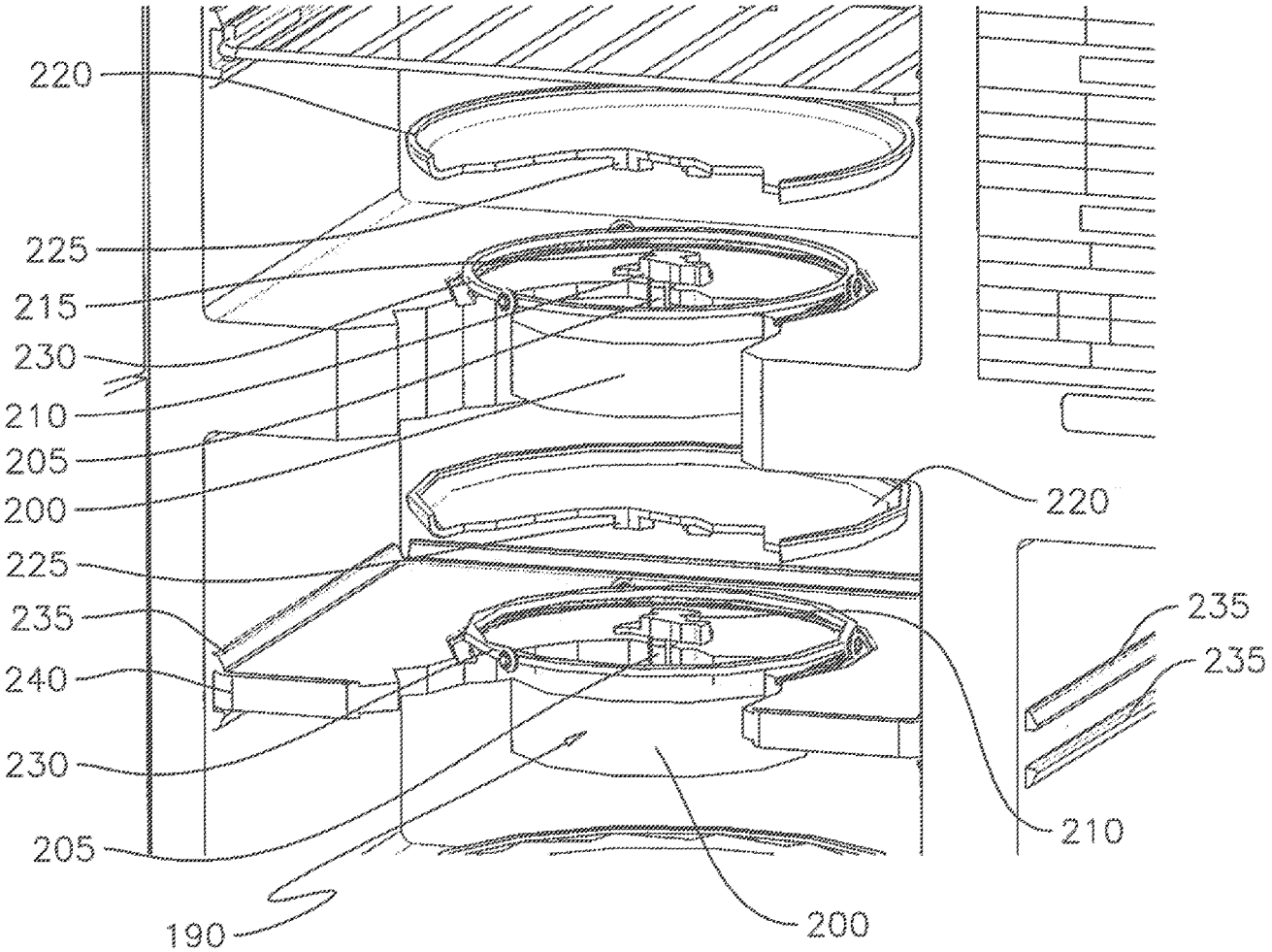
FIG. 6 shows an isometric view, with a partial breakaway, of a tray 240 used in the multi-cavity microwave cooking appliance 10 shown in FIGS. 1 and 2; and, FIG. 7 is an isometric view of a power tap 265 at the rear of the bottom heating cavity 25 and a corresponding plug 270 on the tray 240 used in the multi-cavity microwave cooking appliance 10 in accordance with an alternate embodiment of the present invention.

FIG. 2 presents an isometric view of the multi-cavity microwave cooking appliance 10 with the top cavity door 50, the bottom cavity door 55, and the beverage cavity door 60 open. As such, FIG. 2 shows the interiors of the top heating cavity 20, the bottom heating cavity 25 and the beverage heating cavity 30. The lower surfaces of the top heating cavity 20 and the bottom heating cavity 25 accommodate one (1) or more automatic cavity turntables 190. Because the cavity turntables 190 are the same only one (1) cavity turntable 190 need be explained. Turning now to FIG. 6 a cavity turntable 190 includes an electric motor 200. The electric motor 200 is preferably a copper wound, low profile, reversible motor having a cylindrical drive shaft 205. The electric motor 200 generates sufficient torque to induce rotation of the cavity turntable 190 even when it is loaded with food. The electric motor 200 is preferably mounted under a lower surface. Affixed to the upper end of the drive shaft 205 is a drive hub 210 having teeth 215. Alternatively, splines or a shaft flat or some other such feature that can be used to transfer drive shaft 205 torque instead of teeth 215.

The electric motor 200 rotates a turntable plate 220. Projections 225 disposed on the bottom of the turntable plate 220 engage with the teeth 215 to couple the electric motor 200 to the turntable plate 220. The turntable plate 220 is also supported by a bearing ring 230. The bearing ring 230 provides stability and reduces the required turning effort. The bearing ring 230 includes a plurality of roller bearings or wheels that are attached at evenly spaced locations on a thermoplastic ring. The roller bearings or wheels run around a heating cavity. As is explained in more detail subsequently the cavity turntable 190 beneficially periodically reverses its rotational direction.

Returning back to FIG. 2, the top heating cavity 20, the bottom heating cavity 25, and the beverage heating cavity 30 are each horizontally dividable. The top heating cavity 20 is divided by a removable rack 75 supported on shelf guides 235. This divides the top heating cavity 20 into an upper heating section 80 and a lower heating section 85. The removable rack 75 is preferably comprised of coated carbon steel configured as a rectangle having intermediate lateral supports. The removable rack 75 beneficially is provided with nylon (or another polymer) perimeter edge guards to reduce wear caused by inserting and removing the removable rack 75. However, it is understood that other materials, such as polymers, or reinforced fiber materials, or other composites, or other structural configurations, may be utilized. The shelf guides 235 support the removable rack 75 and any foodstuffs placed thereon. Alternately, the shelf guides 235 may be comprised of a ridge or ridges formed into the walls of the top heating cavity 20.

Referring now to FIGS. 2, 4, 6, and 7, the bottom heating cavity 25 is dividable by a tray 240 into an upper heating section 280 and a lower heating section 285. The tray 240 is supported on shelf guides 235 (described above). As shown, the tray 240 includes a cavity turntable 190 (also described above). Electrical power for the cavity turntable is provided by a power tap 265 that is disposed in the rear wall of the bottom heating cavity 25 close to shelf guides 235. The power tap 265 mates with a plug 270 that is built into the tray 240. Internal wiring of the tray 240 distributes electrical power to an electric motor 200. The tray 240 itself is preferably a rectangular structure comprised of a thermoplastic material and wiring. The tray 240 may also have a metal framework covered with a thermoplastic shell.

Figure 7:
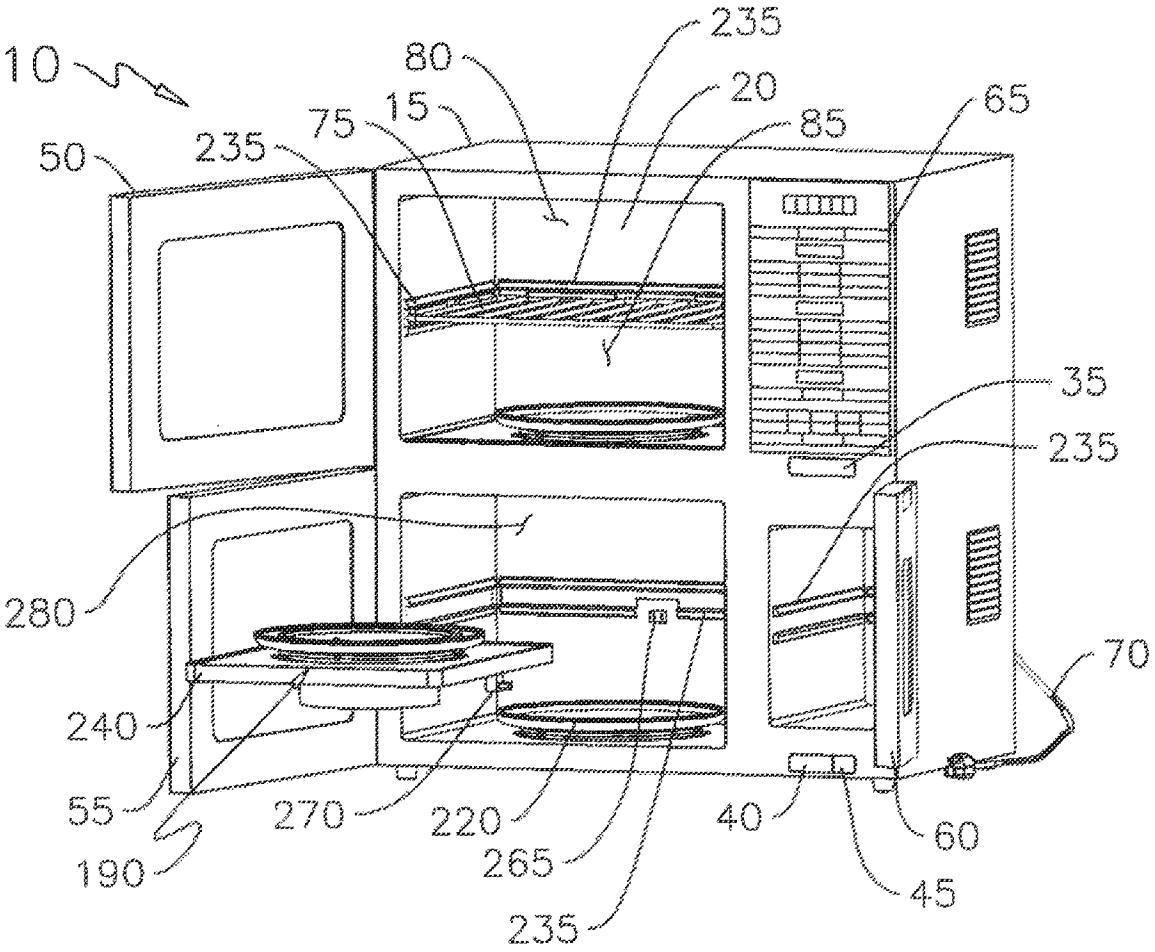

Referring to FIGS. 2, 6, and 7 the beverage heating cavity 30 is also dividable. To that end the beverage heating cavity 30 is provided with shelf guides 235. Those self guides may hold a shelf, tray, or another platform if so desired.

By using removable racks 75, trays 240, or other platforms the multi-cavity microwave cooking appliance 10 becomes highly configurable to suit the needs of its users. More shelving can be added as desired.

Turning to FIG. 4, the operation of the multi-cavity microwave cooking appliance 10 is supported by the control panel 65 that inputs control signals to a main controller 180. The control panel 65 and the main controller 180 enable separate and independent cooking levels within the top heating cavity 20, the bottom heating cavity 25 and the beverage heating cavity 30. The switches used in the control panel 65 may include push-button, momentary contact, toggle, single or multiple poles, one or more keypads or other types of switches. Alphanumeric displays 90 are beneficially located on the lower right front corners of the top cavity door 50 and bottom cavity door 55, but slightly above the beverage cavity door 60 (see FIG. 1). The alphanumeric displays 90 provide users with information regarding the various cavities of the multi-cavity microwave cooking appliance 10, as well as the time of day, cooking levels, cooking times, times remaining and similar functions. As previously noted the alphanumeric displays can be LED's, LCD, plasma, fluorescent, analog, and/or CRT devices.

Figure 3:
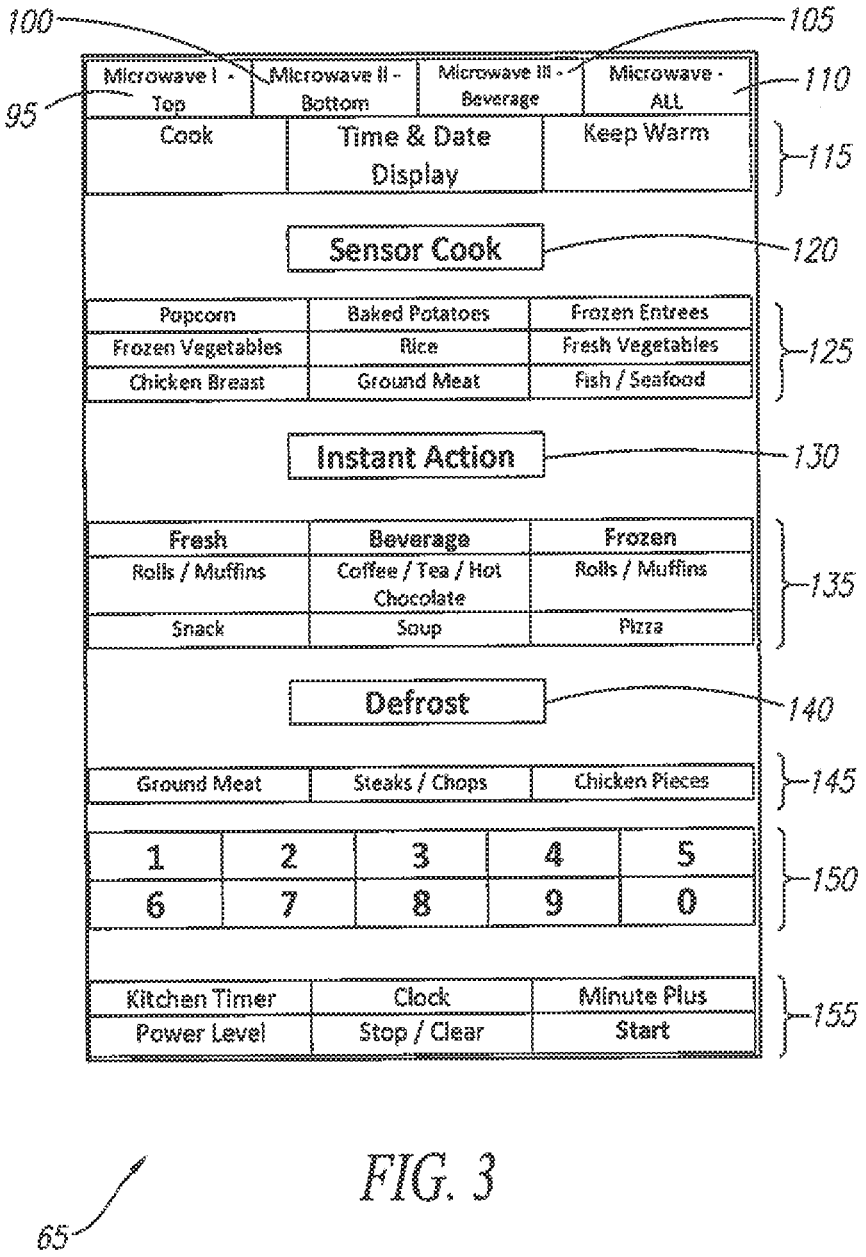
FIG. 3 depicts a detailed front view of a control panel 65 as used with the multi-cavity microwave cooking appliance 10 shown in FIGS. 1 and 2.

FIG. 3 presents a detailed front view of a preferred embodiment control panel 65. The control panel 65 is preferably located along the upper right side of the multi-cavity microwave cooking appliance 10, above the beverage heating cavity 30 and to the right of the top heating cavity 20. The control panel 65 includes a top selector switch 95; a bottom selector switch 100, a beverage selector switch 105, and an all-selector switch 110. The various switches 95, 100, 105 and 110 select which of the various cavities will be controlled by the operating instructions or parameters being entered. More details regarding the top selector switch 95, the bottom selector switch 100, the beverage selector switch 105, and the all-selector switch 110 are provided below.

Below the top selector switch 95, the bottom selector switch 100, the beverage selector switch 105, and the all-selector switch 110 is a series of mode selector switches 115. The mode selector switches include controls such as "COOK", TIME & DATE", "KEEP WARM" and the like. Below the mode selector switches 115 is a sensor cook section 120 that includes a number of sensor cook mode selection switches 125. The sensor cook mode selection switches 125 include selections such as "POPCORN", "RICE", "FROZEN VEGETABLES", "GROUND MEAT", "BAKED POTATO", "FROZEN ENTREES", "FRESH VEGETABLES", "FISH/SEAFOOD", "CHICKEN BREAST" and the like. The foregoing presents useful examples but is not intended to be all inclusive in that other types of controls may be added or used.

Below the mode selector switches 115 is an instant action section 130 that provides a set of instant action selection switches 135. The instant selection switches automatically set suitable power levels and cooking times for food stuffs and beverages often cooked or heated in the multi-cavity microwave cooking appliance 10. Such instant action selection switches 135 may include selections such as "FRESH", "BEVERAGE", "FROZEN", "ROLLS/MUFFINS", "SOUP", "PIZZA" AND THE LIKE. Again, those examples are not all inclusive and are only examples of useful instant action switches.

Below the instant action section 130 is a defrost section 140. The defrost section 140 includes a series of defrost mode selection switches 145 that work in conjunction with a numeric keypad 150. The defrost mode selection switches 145 are envisioned to include selections such as "GROUND MEAT", "STEAKS/CHOPS", or "CHICKEN PIECES" or other commonly defrosted foodstuffs.

Below the defrost section 140 is the numeric keypad 150. The numeric keypad 150 is used for entering numeric values such as cooking times, current local time, power levels and the like. When used with the defrost mode selection switches 145 the numeric keypad 150 can be used to enter the weight of the food stuff being defrosted.

Below the numeric keypad 150 is a set of auxiliary operation parameter switches 155. The auxiliary operation parameter switches 155 enable control of various parameters such as "KITCHEN TIMER", "CLOCK", "MINUTE PLUS", "POWER LEVEL", "STOP/CLEAR", and "START". Operating sequences controlled by the control panel 65 will follow normal programming sequences as used in conventional microwave ovens. However, the multi-cavity approach as well as the beverage heating cavity 30 provide far greater flexibly in cooking and heating than a conventional microwave oven. Such operating sequences are well known, flexible, easily programmed and readily incorporated by one skilled in the applicable arts and are not nor need be discussed in more detail.

FIG. 4 presents a schematic block diagram of the major electrical components of the multi-cavity microwave cooking multi-cavity microwave cooking appliance 10. Electrical power is input via the power cord 70. The input power is passed to a power supply 160 which converts the input power into the high voltage required to operate a top cavity magnetron 165, a bottom cavity magnetron 170, and/or a beverage cavity magnetron 175, which are respectively located upon the top heating cavity 20, the bottom heating cavity 25 and the beverage heating cavity 30.

The input power also supplies a lower DC voltage to operate the main controller 180. The main controller 180 is a microprocessor controlled unit that accepts user commands from the top selector switch 95, the bottom selector switch 100, the beverage selector switch 105, and the all-selector switch 110 as well as from the other switches of the control panel 65. Depending on which switch was last activated (from amongst the top selector switch 95, the bottom selector switch 100, the beverage selector switch 105, and the all-selector switch 110) the main controller 180 directs incoming cooking commands from the control panel 65 to control either the top cavity magnetron 165, the bottom cavity magnetron 170 or the beverage cavity magnetron 175 as required.

Still referring to FIG. 4, as previously noted the cavity turntable 190 periodically changes direction. If the cavity turntable 190 is built into the enclosure 15 this is accomplished by the main controller 180 periodically reversing the polarity of the electrical power applied to the electric motor 200 of the cavity turntable 190. However, if the cavity turntable 190 is part of a tray 240 this is accomplished by the main controller 180 periodically reversing the polarity of the electrical power applied to the power tap 265.

In addition, to inform the user of the status of the multi-cavity microwave cooking appliance 10, the operating environment, or the status of the food stuff being operated on by the multi-cavity microwave cooking appliance 10 the main controller 180 causes user information to be output via the alphanumeric displays 90.

FIG. 5 illustrates a rear view of the enclosure 15 prior to final assembly of the multi-cavity microwave cooking appliance 10. The enclosure 15 includes an enclosure rear **16*a* though which the power cord 70 passes. The enclosure 15 also includes an enclosure bottom 16*d* having four adjustable legs 19 with feet 18. FIG. 5 also shows the enclosure left side 16*e* having a vent opening 12 for a louvered vent 13 (see FIGS. 1 and 2**).

It is envisioned that other styles and configurations of the present invention can be easily incorporated into the teachings of the present invention, and only one (1) particular configuration shall be shown and described for purposes of clarity and disclosure and not by way of limitation of scope.

The preferred embodiment of the present invention can be utilized by the common user in a simple and effortless manner with little or no training. It is envisioned that the multi-cavity microwave cooking appliance 10 would be constructed in general accordance with FIG. 1 through FIG. 7.

To use the multi-cavity microwave cooking appliance 10 a user would place one or more items to be processed by the multi-cavity microwave cooking appliance 10 into an appropriate cavity or cavities of the cooking multi-cavity microwave cooking appliance 10. Those cavities include the top heating cavity 20, the bottom heating cavity 25 and/or the beverage heating cavity 30.

Further placement of food stuffs in either the upper heating section 80 or the lower heating section 85 may be made as well in each of the top heating cavity 20 and bottom heating cavity 25 should either the removable rack 75 or the tray 240 be present. The user would then press the top selector switch 95, the bottom selector switch 100, the beverage selector switch 105, or the all-selector switch 110, depending on the desired cooking/heating scenario. Next, the user would select the desired cooking/heating functionality for all or the specific cavity by the control panel 65. Finally, cooking/heating is allowed to progress. When complete the various foodstuffs and/or beverage is removed from the multi-cavity microwave cooking appliance 10 thus allowing for re-use as needed.

It should be noted that the multi-cavity microwave cooking appliance 10 allows for one (1) or more of the top heating cavity 20, the bottom heating cavity 25 or the beverage heating cavity 30 to be used simultaneously as necessary. The multi-cavity microwave cooking appliance 10 also has the ability to fully cook one (1) foodstuff while having another foodstuff in another cavity on a timer and ready to be cooked/heated such that completion time is simultaneous.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A multi-cavity microwave cooking appliance, comprising:

an enclosure having an upper heating cavity, a lower heating cavity having a lower heating cavity vent disposed below said upper heating cavity, and a vertically elongated beverage heating cavity having a beverage heating cavity vent disposed besides said lower heating cavity;

a vented control panel for setting separate and independent cooking levels within said upper heating cavity, said lower heating cavity, and said beverage heating cavity, said control panel disposed along side said upper heating cavity and directly above said beverage heating cavity;

an upper cavity magnetron for supplying microwave energy to said upper cavity;

an upper cavity fan for cooling said upper cavity magnetron;

a lower cavity magnetron for supplying microwave energy to said lower cavity;

a lower cavity fan for cooling said lower cavity magnetron by moving heated air from said lower cavity magnetron through said lower cavity vent;

a beverage cavity magnetron for supplying microwave energy to said beverage cavity;

a beverage cavity fan for cooling said beverage cavity magnetron by moving heated air from said beverage cavity magnetron through said beverage cavity vent;

a power supply for selectively applying magnetron operating voltages to said upper cavity magnetron, to said lower cavity magnetron, and to said beverage cavity magnetron, said power supply further for supplying an electronic operating voltage; and, a main controller for accepting user commands from said control panel, said main controller further for controlling said power supply to selectively apply magnetron operating voltages to said upper cavity magnetron, to said lower cavity magnetron, and to said beverage cavity magnetron, said main controller further for applying electrical power to said upper cavity fan, to said lower cavity fan, and to said beverage cavity fan.

2. The multi-cavity microwave cooking appliance according to claim 1, further including:

a first alphanumeric display for providing a user with information regarding said upper heating cavity;

a second alphanumeric display for providing a user with information regarding said lower heating cavity; and, a beverage alphanumeric display for providing a user with information regarding said beverage heating cavity;

wherein said first alphanumeric display, said second alphanumeric display, and said beverage alphanumeric display are operatively connected to said main controller.

3. The multi-cavity microwave cooking appliance according to claim 2, wherein said first alphanumeric display is located on said upper cavity access door.

4. The multi-cavity microwave cooking appliance according to claim 2, wherein said information regarding said upper heating cavity is data from a list comprising time of day, cooking levels, cooking times, times remaining, and temperature.

5. The multi-cavity microwave cooking appliance according to claim 1, wherein said upper heating cavity is separated into two heating sections by a removable rack, and wherein said lower heating cavity is separated into two heating sections by a removable tray.

6. The multi-cavity microwave cooking appliance according to claim 1, wherein said control panel includes a first selector switch, a second selector switch, a beverage selector switch, and an all-selector switch.

7. The multi-cavity microwave cooking appliance according to claim 6, wherein said main controller controls said upper cavity magnetron if said first selector switch was last pressed.

8. The multi-cavity microwave cooking appliance according to claim 7, wherein said main controller controls said upper cavity magnetron, said lower cavity magnetron, and said beverage cavity magnetron if said all-selector switch was last pressed.

9. The multi-cavity microwave cooking appliance according to claim 8, wherein said control panel applies a mode selector command to said main controller.

10. The multi-cavity microwave cooking appliance according to claim 9, wherein said mode selector command is a command from a list consisting of: cook, time, date, keep warm and defrost.

11. The multi-cavity microwave cooking appliance according to claim 8, wherein said control panel applies a sensor cook command to said main controller.

12. The multi-cavity microwave cooking appliance according to claim 11, wherein said sensor cook command is a command from a list consisting of popcorn, rice, frozen vegetables, ground meat, baked potato, frozen entrees, fresh vegetables, fish, and seafood.

13. The multi-cavity microwave cooking appliance according to claim 8, wherein said control panel applies a defrost mode command to said main controller.

14. The multi-cavity microwave cooking appliance according to claim 13, wherein said defrost mode command is a command from a list consisting of ground meat, steaks, chops, chicken.

15. The multi-cavity microwave cooking appliance according to claim 8, wherein said control panel applies a numeric command to said main controller.

16. The multi-cavity microwave cooking appliance according to claim 15, wherein said numeric command is a command from a list consisting of cooking time, current time, power level and weight.

17. The multi-cavity microwave cooking appliance according to claim 8, wherein said control panel applies an auxiliary operation parameter to said main controller.

18. The multi-cavity microwave cooking appliance according to claim 17, wherein said auxiliary operation parameter is a command from a list consisting of timer, clock, plus, power level, stop, clear and start.

19. The multi-cavity microwave cooking appliance according to claim 1, wherein said main controller enables independent cooking levels within said upper heating cavity, said lower heating cavity, and said beverage heating cavity.

* * * * *